United States Patent [19]

Kato et al.

[11] Patent Number: 5,051,100

[45] Date of Patent: Sep. 24, 1991

[54] ELECTRICAL CONNECTOR

[75] Inventors: Tetsuo Kato; Kiyohito Fukuda; Katsuaki Terada; Naoto Taguchi, all of Shizuoka, Japan

[73] Assignee: Yazaki Corporation, Tokyo, Japan

[21] Appl. No.: 544,724

[22] Filed: Jun. 27, 1990

[30] Foreign Application Priority Data

Jun. 27, 1989 [JP] Japan ..... 1-162626

[51] Int. Cl.[5] ..... H01R 13/447

[52] U.S. Cl. ..... 439/140; 439/137; 439/367; 439/595

[58] Field of Search ..... 439/138, 137, 140, 147, 439/137, 595, 599, 603

[56] References Cited

U.S. PATENT DOCUMENTS

| | | | |
|---|---|---|---|
| 4,557,542 | 12/1985 | Coller et al. | 439/595 |
| 4,593,960 | 6/1986 | Millhimes et al. | 439/140 |
| 4,791,608 | 12/1988 | Fushimoto | 439/140 |
| 4,944,695 | 7/1990 | Tsuji et al. | 439/595 |
| 4,944,696 | 7/1990 | Sueyoshi et al. | 439/595 |
| 4,959,021 | 9/1990 | Byrne | 439/137 |
| 4,992,054 | 2/1991 | Cassan | 439/329 |

*Primary Examiner*—Paula A. Bradley
*Attorney, Agent, or Firm*—Sughrue, Mion, Zinn, Macpeak & Seas

[57] ABSTRACT

An electrical connector has a protective cover which moves slidably between a first position, which exposes a plurality of metal terminals to corresponding portions of a printed circuit board, and a second position, which covers the terminals. Unless the connector is inserted properly, the protective cover will cover the terminals, preventing contact with the printed circuit board. A detecting piece on a mating connector housing the printed circuit contacts moves the protective cover when the connector is inserted into the mating connector.

5 Claims, 9 Drawing Sheets

ELECTRICAL CONNECTOR

BACKGROUND OF THE INVENTION

This invention relates to an electrical connector of the type in which a resilient contact piece of each terminal is exposed from a terminal-receiving chamber of a connector housing when the terminal is received in the terminal-receiving chamber.

Conventionally, it is well known to fit a connector, in which resilient contact pieces are exposed from respective terminal-receiving chambers, in a receiving space in a mating connector having a printed circuit board attached thereto, thereby making an electrical connection between the two connectors. The connector used for this purpose has an open portion in the terminal-receiving chamber, and the resilient contact piece of the terminal is exposed from this open portion. As a result, the resilient contact piece is liable to be affected by an external force, and is susceptible to damage or deformation, which may cause imperfect contact.

In view of the above, Japanese Utility Model Publication No. 10470/82 proposes a technique, shown in FIG. 16, in which a protective cover e is provided slidably within grooves b, which in turn are provided in opposite side portions of a connector housing a. Sliding the cover e opens and closes an exposing surface of a resilient contact piece d of each terminal c. When the connector is in its non-fitted condition, the protective cover e is closed to protect the resilient contact pieces d. On the other hand, when the connector is to be fitted or engaged in a mating connector f mounted on a meter for an automobile or the like, the protective cover e is urged upwardly, as indicated by arrow P, to expose the resilient contact pieces d, and the connector is fitted in a receiving space q in the mating connector f to urge the resilient contact pieces d into contact with conductors i on a printed circuit board h, thereby making an electrical connection.

However, in the just-described structure, even when the terminal c is inserted imperfectly into the connector housing a, the connector can be fitted in the mating connector f, resulting in an imperfect connection.

Further, the protective cover e can be opened and closed easily, and therefore there are occasions when the protective cover e is opened accidentally, exposing the resilient contact pieces d and subjecting them to damage or deformation.

Still further, when the connector a is to be withdrawn from the mating connector f, the protective cover e remains opened to expose the resilient contact pieces d, and therefore the resilient contact pieces may be damaged or deformed.

SUMMARY OF THE INVENTION

In view of the foregoing, it is an object of this invention to provide a connector having a protective cover which prevents an imperfect insertion of a terminal, will not be opened accidentally, and is closed automatically upon withdrawal of the connector from a mating connector.

The above and other objects have been achieved by a connector wherein a detecting space is provided adjacent to a terminal-receiving chamber; a flexible retainer piece for retaining a terminal received in the terminal-receiving chamber is provided in displaceable fashion between the terminal-receiving chamber and the detecting space; a protective cover comprises a cover body, a detecting member, and a connecting lever interconnecting the cover body and the detecting member; the detecting member is movably received in the detecting space; and, when the terminal is inserted imperfectly into the terminal-receiving chamber, the flexible retainer piece prevents the detecting member from advancing.

A drive projection, abutting the protective cover so as to open the cover, is provided on a mating connector. Also, there is provided a communicating passage which intersects the plane opened and closed by the protective cover and extends through the connector housing. The protective cover has an engaging lever extending through the communicating passage. A locking arm is mounted on the connector housing, the locking arm having at one end an engaging portion engageable with the engaging lever, a manipulating portion at the other end thereof, and a flexible support post intermediate the opposite ends thereof by which the locking arm is secured to the connector housing.

In a further modified form of the invention, the protective cover has a retaining portion, and the mating connector has a retaining portion for retaining engagement with the retaining portion of the protective cover.

When the terminal is inserted imperfectly, the distal end of the flexible retainer piece for the terminal is projected into the detecting space so as to prevent advancement of the detecting member. Therefore, the protective cover is not opened. Since the protective cover thus is not opened, fitting the connector into the mating connector is impossible, thus preventing imperfect connection between the two connectors.

When the connector is to be inserted or fitted, the protective cover is urged by the drive projection, formed on the mating connector, to be opened. Therefore, there is no possibility of damaging a printed circuit board.

To prevent accidental opening of the protective cover, the engaging lever formed on the protective cover is engaged with the engaging portion, formed on one end of the flexible retainer piece, to prevent movement of the protective cover in its opening direction, thereby preventing such accidental opening.

Further, by retaining the protective cover relative to the mating connector, the protective cover is returned to close the exposing portion of the resilient contact piece without fail when the fitting of the connector is released, thus positively protecting the resilient contact piece.

DETAILED DESCRIPTION OF THE PREFERRED EMBODIMENTS

Figure 1:
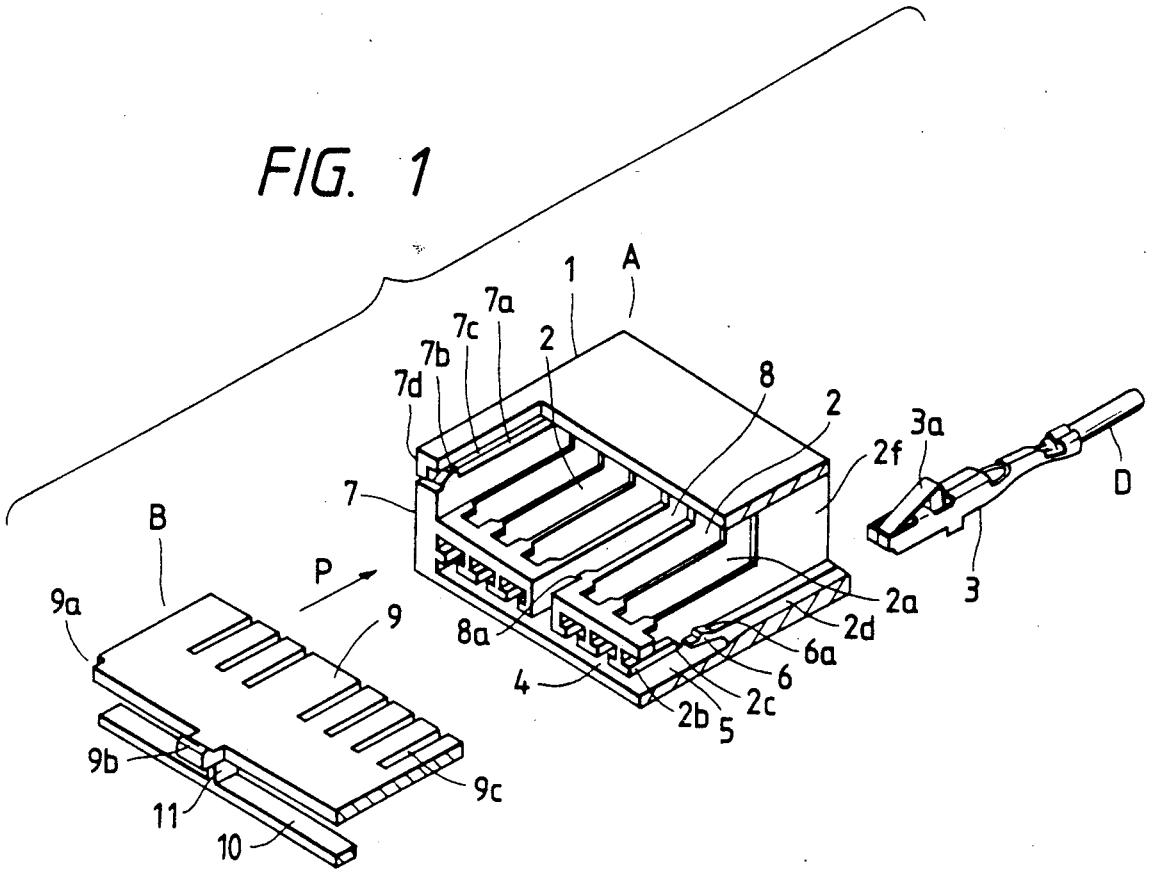
FIG. 1 is an exploded perspective view, partly in section, of a connector provided in accordance with the invention.

The invention now will be described in detail with reference to the drawings. In FIGS. 1 to 5, reference character A denotes a connector, reference character B a protective cover for opening and closing exposing portions of terminals of the connector A, reference character C a mating connector mounted on a meter for an automobile or the like, and reference character D a wire harness connected to the terminal of the connector.

In FIG. 1, a plurality of juxtaposed terminal-receiving chambers 2 are provided in a connector housing 1 of the connector A. When the terminal 3 is received in the terminal-receiving chamber 2, a resilient contact piece 3*a* of the terminal 3 is exposed from an open portion 2*a* of the terminal-receiving chamber 2. A detecting space 4 is provided adjacent to the terminal-receiving chamber 2, that is, between the terminal-receiving chamber 2 and a bottom plate 5.

Figure 2:
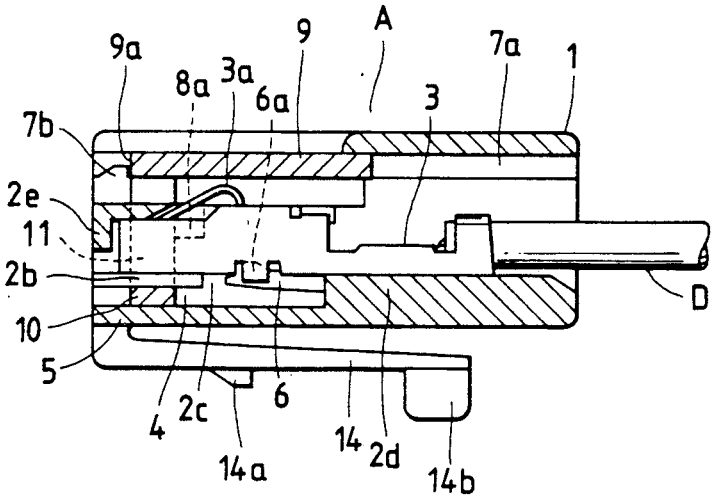
FIG. 2 is a vertical cross-sectional view of the connector of FIG. 1.

In FIG. 2, a notch 2*c*, formed in a bottom wall 2*b* of the terminal-receiving chamber 2, communicates with the detecting space 4. A flexible retainer piece 6 for the terminal is formed integrally with a peripheral wall portion 2*d* forming the terminal-receiving chamber, and is disposed in the notch 2*c*. In a natural condition, a retaining portion 6*a* provided at the distal end of the flexible retainer piece 6 is projected into the terminal-receiving chamber 2. However, when the retainer piece 6 receives a pressing or urging force from the side of the terminal-receiving chamber 2, the distal retaining portion 6*a* is projected into the detecting space 4 via the notch 2*c*.

Grooves 7*a*, along which the protective cover B is slidable, are formed respectively in opposing side walls 7 (only one of which is shown in FIG. 1) of the connector housing 1. A retainer projection 7*b* is formed in the vicinity of the inlet of the groove 7*a*. A slit 7*c* is formed in the side wall 7 to form a flexible portion 7*d*, and therefore that portion disposed adjacent to the inlet of the groove 7*a* allows easy insertion of the protective cover B.

Referring again to FIG. 1, a communicating passage 8, formed in the connector housing 1, substantially perpendicularly intersects the plane opened and closed by the protective cover B (that is, the plane passing through the opposing grooves 7*a*), and communicates with the detecting space 4. A retainer projection 8*a* is formed in the vicinity of the inlet of the communicating passage 8.

The protective cover B includes a cover body 9, a detecting member 10, and a connecting lever 11 interconnecting the cover body 9 and the detecting member 10. The protective cover B is attached to the connector housing 1 in such a manner that the opposite ends of the cover body 9 are inserted into respective grooves 7*a*, the detecting member 10 is inserted into the detecting space 4, and the connecting lever 11 is inserted into the communicating passage 8. Slits 9*c* fit around respective partition walls 2*f*.

Figure 3:
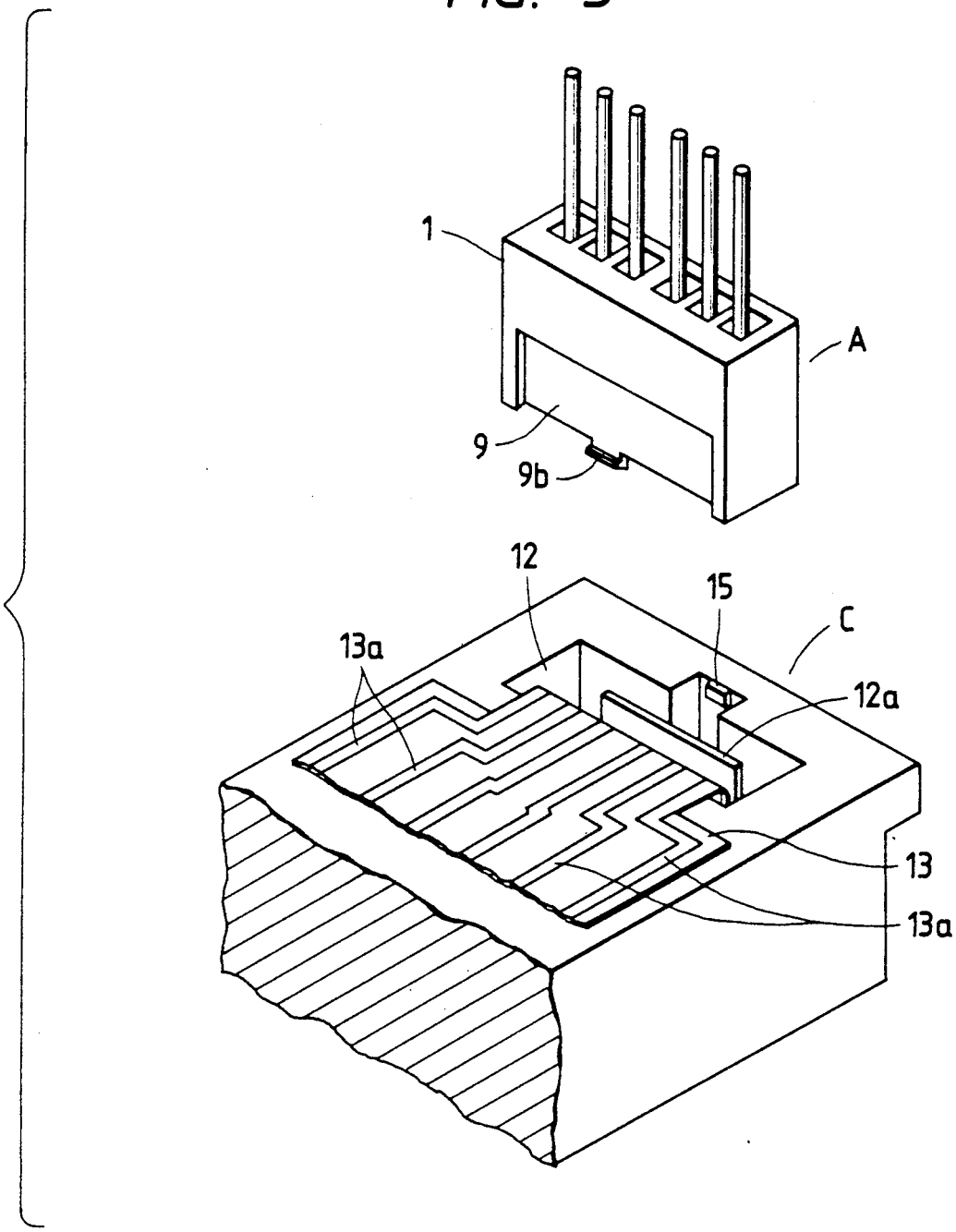
FIG. 3 is an exploded perspective view showing the connector of FIG. 1 and a mating connector.

Referring to FIG. 3, the mating connector C has a receiving space 12 for receiving the connector A. A printed circuit board 13 for pressing contact with the resilient contact pieces 3*a* of the terminals 3 is bonded to the mating connector C along the receiving space 12. A drive projection 12*a*, abutting the detecting member 10 of the protective cover B, is provided at the bottom portion of the receiving space 12, and is upstanding in the direction of insertion of the connector A. The drive projection 12*a* may have either a plate-like shape or a rod-like shape.

Assembly of the connector A now will be described. First, the terminal 3, to which the wire harness D already has been connected, is inserted into the terminal-receiving chamber 2 of the connector housing 1, so that the distal retaining portion 6*a* of the flexible retainer piece 6 is received in a retaining hole 3*b* (see FIG. 5) in the terminal 3. Therefore, the terminal 3 received in the terminal-receiving chamber 2 is stopped by a front wall 2*e* (FIG. 2) of the terminal-receiving chamber 2 serving as a stopper, and is prevented by the flexible retainer piece 6 from retracting. The resilient contact piece 3*a* of the terminal 3 is kept exposed from the open portion 2*a* of the terminal-receiving chamber 2.

Then, the protective cover B is moved in the direction of arrow P, and is attached to the connector housing 1 in such a manner that the opposite ends of the cover body 9 are inserted into respective grooves 7*a*, the detecting member 10 is inserted into the detecting space 4, and the connecting lever 11 is inserted into the communicating passage 8, as described above. The cover body 9 flexes the flexible portions 7*d* of the grooves 7*a*, and slides over the projections 7*b* so as to be inserted forcibly, thereby closing the exposing portion of each resilient contact piece 3*a*. Then, the projections 7*b* are brought into engagement with a retaining end 9*a* of the cover body 9, thereby preventing accidental disengagement of the protective cover B from the connector housing 1.

At the same time, as shown in FIG. 2, the projection 8*a* in the communicating passage 8 is engaged with the connecting lever 11 of the protective cover B, thereby preventing movement of the protective cover B in the opening direction (that is, in the direction of arrow P). Thus, the protective cover B is retained provisionally in its closed condition, and will not be opened accidentally.

To open the protective cover B, a force, acting in the direction of arrow P and being sufficient to cause the connecting lever 11 to slide over the projection 8*a*, is applied to the protective cover B, for example, through a handgrip 9*b* (FIG. 1). The connecting lever 11 slides over the projection 8*a* and advances along the communicating passage 8, and the cover body 9 opens the exposing portion of each resilient contact piece 3*a*.

Next, the fitting or inserting the connector A, kept in the condition of FIG. 2, into the mating connector C will be described, with reference to FIGS. 4 and 5.

Figure 4:
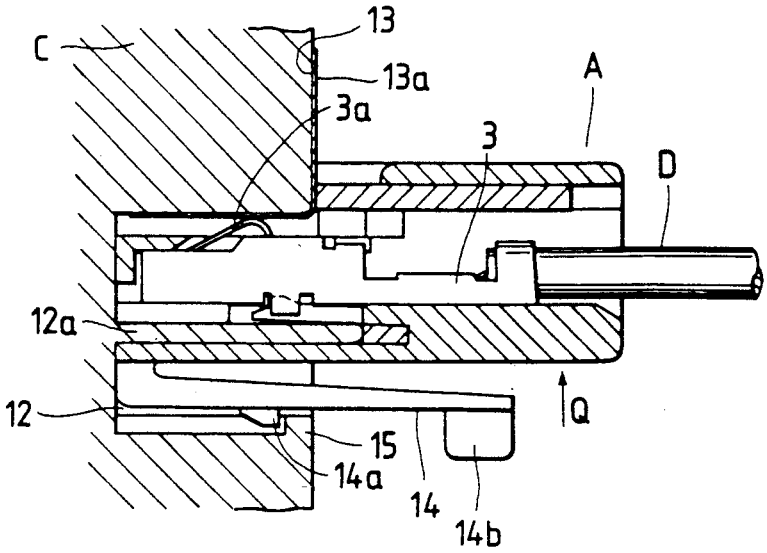
FIG. 4 is a vertical cross-sectional view showing the fitting of the connector of FIG. 1 in the mating connector.
Figure 5:
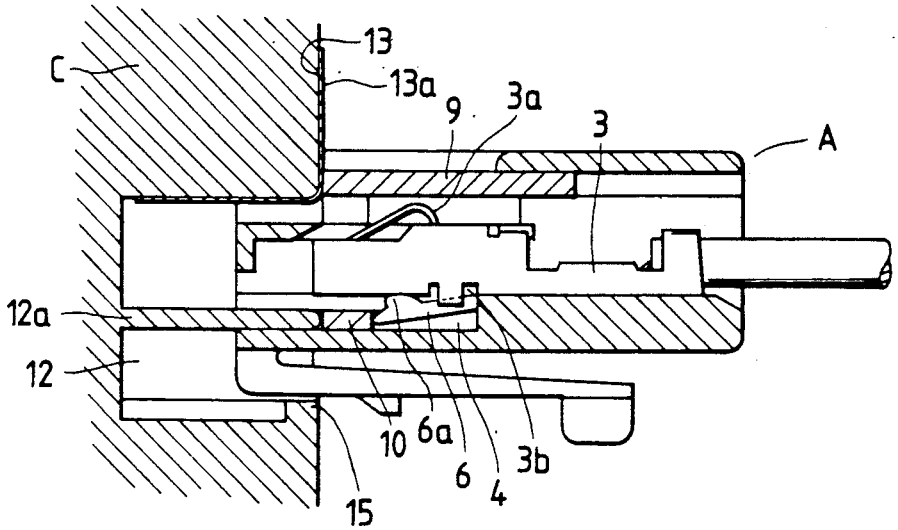
FIG. 5 is a view similar to FIG. 4, but showing an imperfect fitting condition.

When the fitting end of the connector A is inserted in the receiving space 12 in the mating connector C shown in FIGS. 4 and 5, the distal end of the drive projection 12*a* is inserted into the detecting space 4, and is brought into engagement with the detecting member 10. In this condition, when the force is applied further in the direction of fitting of the connector A, the drive projection 12*a* urges the detecting member 10, so that the connecting lever 11 slides over the projection 8*a* and advances along the communicating passage 8 (FIG. 2). At this time, the protective cover B is moved in the opening direction to open the exposing surface of each resilient contact piece 3*a*.

At the time of this opening operation, the connector A is fitted in the receiving space 12 in the mating connector C, and the resilient contact pieces 3*a* are pressed into contact with circuit conductors 13*a* on the printed circuit board 13, thereby making electrical connection. Since the pressing force is not applied directly to the printed circuit board 13, the board is not subjected to damage. Finally, a retaining portion 14*a* of a flexible retainer piece 14, formed on the lower portion of the connector A, is engaged with a retaining portion 15 on the mating connector C, thus completing the fitting of the connector A.

To withdraw the connector A from the mating connector C, a manipulating portion 14*b*, provided on the distal end of the flexible retainer piece 14, is pressed in a direction of arrow Q to release the engagement between the retainer portion 14*a* and the retainer portion 15, and then the connector A is withdrawn.

FIG. 5 shows a condition of imperfect insertion of the terminal 3 into the connector A. In this case, the flexible retainer piece 6 for the terminal abuts the lower surface of the terminal 3, and is urged downwardly. The distal retaining portion 6*a* is projected into the detecting space 4. In this condition, if it is intended to open the protective cover B, the detecting member 10 abuts the retaining portion 6*a* of the flexible retainer piece 6, and cannot advance. The drive projection 12 of the mating connector C is held in contact with the detecting member 10 of the protective cover B. Therefore, the fitting of the connector A also is prevented, thus avoiding an imperfect connection. That is, the detecting member 10 checks whether the terminal 3 is inserted completely into the connector A.

Conventionally, even if the terminal 3 is inserted imperfectly, the connector can be fitted, causing an imperfect connection of the connector. However, with the construction of the invention as shown in FIGS. 1 to 5, the fitting of the connector is prevented positively if the terminal is imperfectly inserted.

Figure 7:
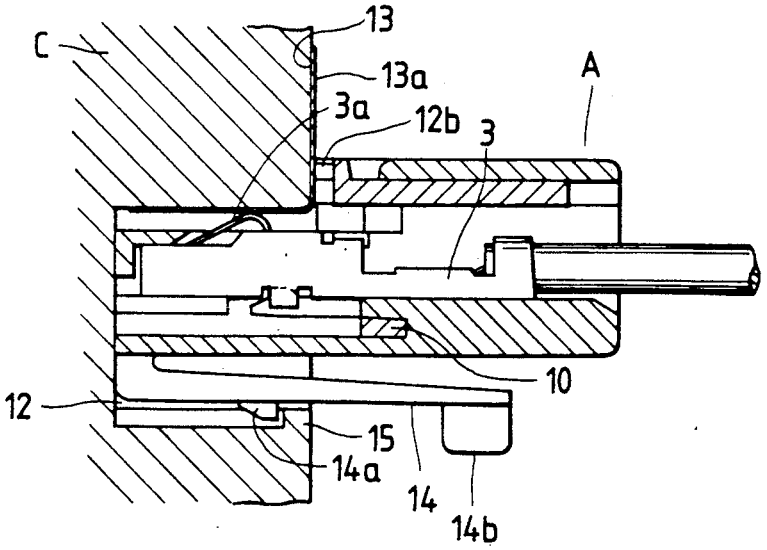
FIG. 7 is a vertical cross-sectional view showing the fitting of the connector of FIG. 6 in the mating connector.
Figure 6:
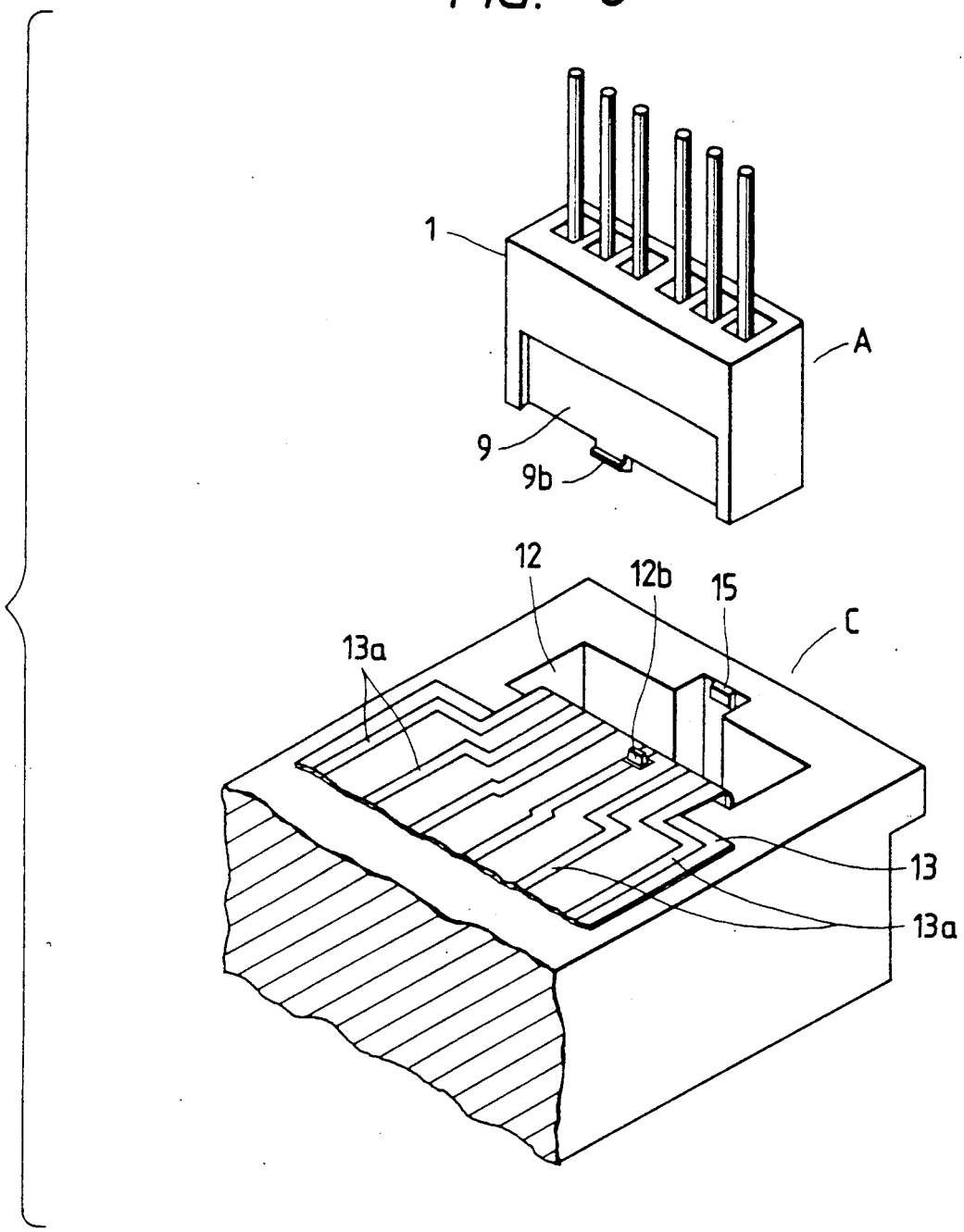
FIG. 6 is an exploded perspective view of a modified form of the invention.
Figure 8:
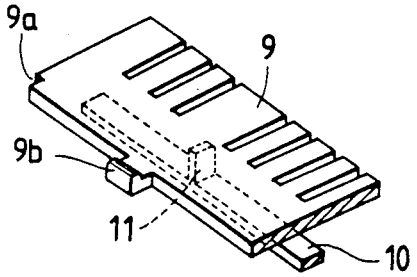
FIG. 8 is a perspective view of a modified protective cover.

FIGS. 6 to 8 show a modified form of the invention. While most parts of this embodiment are similar to those of the preceding embodiment of FIG. 1, the embodiment differs in that, instead of the drive projection 12*a* provided in the receiving space 12 of the mating connector C, a drive projection 12*b* is provided in the vicinity of the inlet of the receiving space 12, the drive projection 12*b* extending through the printed circuit board 13. When the connector A is to be fitted in the connector C, the drive projection 12*b* urges the handgrip 9*b* formed on the protective cover B, thereby opening the protective cover B.

In the construction shown in FIGS. 6 to 8, since it is not necessary to urge the detecting member 10 directly, the detecting member 10 can be disposed inwardly of the cover body 9, as shown in FIGS. 7 and 8. Therefore, the imperfect insertion of the terminal 3 can be detected at an earlier stage of the fitting of the connector.

FIGS. 9 to 12 show another modified form of the invention. In this embodiment, the protective cover B is locked in its closed condition, and if this locking is not released, the protective cover B cannot be opened. The purpose of this embodiment is to enhance the protection of the resilient contact pieces 3*a*.

Figure 10:
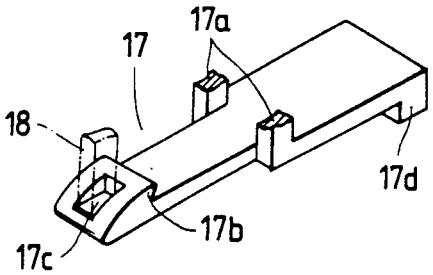
FIG. 10 is a perspective view of a locking arm.
Figure 9:
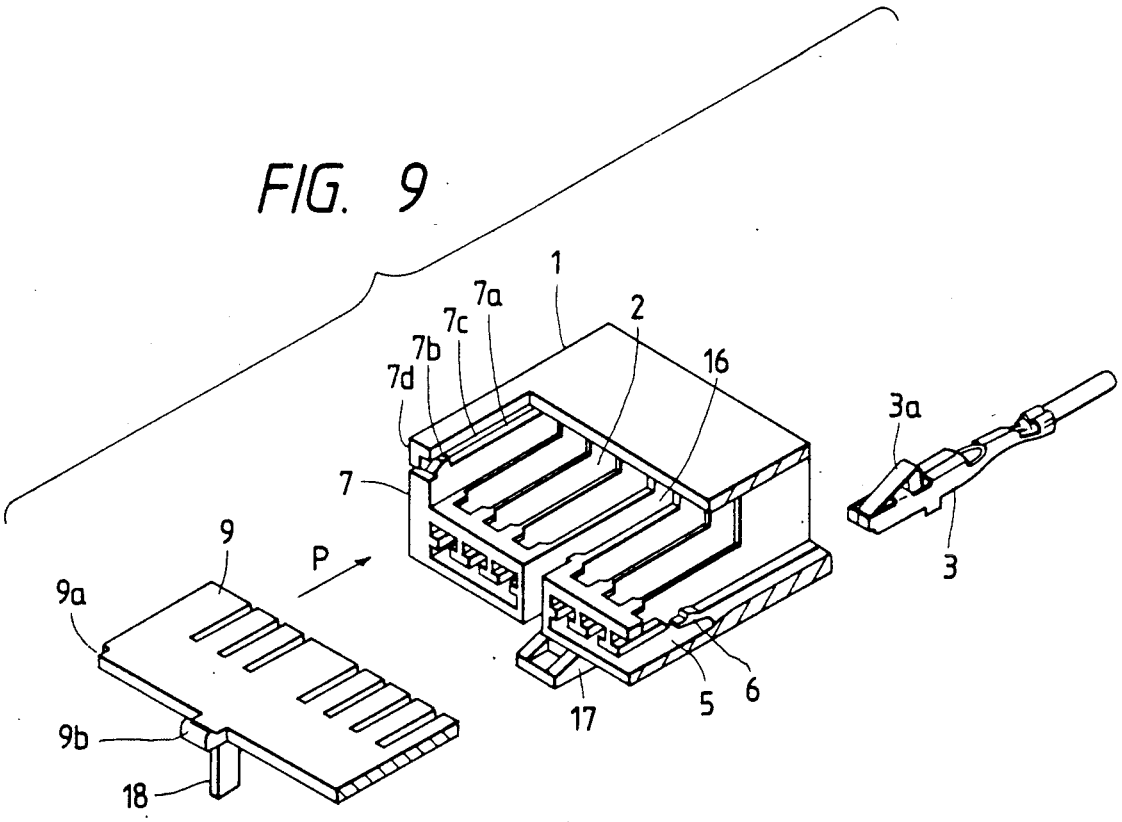
FIG. 9 is a partly-broken, exploded perspective view, showing another modified connector.

In this embodiment, a through passage 16, substantially perpendicular to the plane opened and closed by the protective cover B (that is, the plane passing through the opposite grooves 7*a*), is formed through a connector housing 1. A locking arm 17 is provided below the through passage 16, that is, on the outer surface of the bottom plate 5 of the connector housing 1. As shown in FIG. 10, the locking arm 17 is supported intermediate opposite ends thereof on the bottom plate 5 by a pair of upstanding flexible support posts 17*a* and 17*a* disposed respectively on the opposite sides of the through passage 16. The locking arm 17 has at its left-hand end a retaining portion 17*b* for engaging a retaining portion of the mating connector C. An engaging portion 17*c* in the form of a recess having a substantially right-angular corner is formed in the retaining portion 17*b*. The right-hand end of the locking arm 17 serves as a manipulating portion 17*d*.

An engaging lever 18 extends perpendicularly from the cover body 9 of the protective cover B, the engaging lever 18 extending through the through passage 16. The distal end of the engaging lever 18 is engageable with the engaging portion 17*c* of the locking arm 17.

Figure 11:
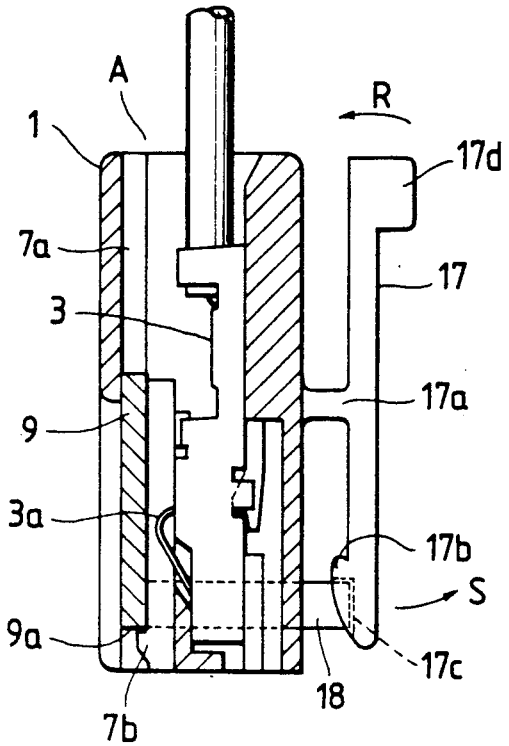
FIG. 11 is a vertical cross-sectional view of the connector of FIG. 9.
Figure 12:
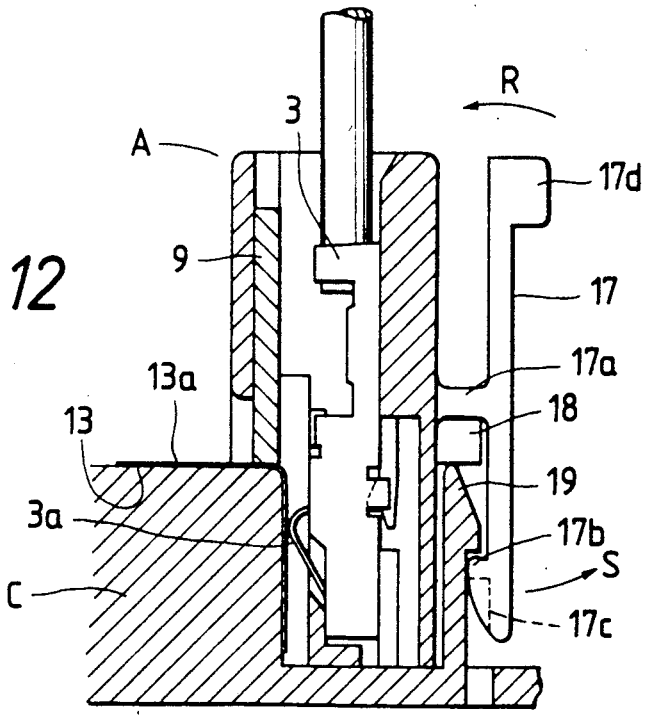
FIG. 12 is a vertical cross-sectional view showing the fitting of the connector of FIG. 9 in the mating connector.

As shown in FIG. 11, the protective cover B is received in the connector housing 1. In this condition, the protective cover B is prevented from disengaging the connector housing 1 because of the engagement between the projection 7*b* and the end 9*a* of the cover body 9. Also, the protective cover B is prevented from advancing because of the engagement between the engaging lever 18 and the engaging portion 17*c*. Thus, the protective cover B is locked in its closed position.

To fit this connector A in the mating connector C, the distal end of the locking arm 17 first is abutted against a retaining projection 19 formed on the mating connector C. Then, when the connector A is pushed further, the distal end of the locking arm 17 is displaced or moved in a direction of arrow S because of contact of its inclined surface with the inclined surface of the retaining projection 19. As a result, the engagement between the engaging portion 17*c* and the engaging lever 18 is released. Subsequently, the distal end of the retaining projection 19 urges the engaging lever 18, so that the protective cover B is opened by the retaining projection 19. At the same time, the connector A is fitted in the mating connector C. This fitting condition is maintained by the engagement between the retaining projection 19 and the retaining portion 17*b*. Therefore, electrical connection between the circuit conductors 13*a* on the printed circuit board 13 and the resilient contact pieces 3*a* of the terminals is maintained.

Next, the releasing of the fitting of the connector A in the mating connector C will be described. When a force acting in a direction of arrow R (FIG. 12) is applied to the manipulating portion 17*d* of the locking arm 17, the retaining portion 17*b* is displaced in the direction of arrow S, so that the engagement between the retaining projection 19 and the retaining portion 17*b* is released. Therefore, by withdrawing the connector A upwardly, the fitting of the connector A can be released. The protective cover B is caused to move downwardly by its own weight to close the exposing surfaces of the resilient contact pieces 3*a*. The distal end of the engaging lever 18 is engaged in the engaging portion 17*c*, thus recovering the condition shown in FIG. 11.

In the embodiment shown in FIGS. 9 to 12, even if an external force is applied to the protective cover B, the protective cover B will not be opened, and the resilient contact pieces 3*a* of the terminals 3 can be protected positively.

Figure 13:
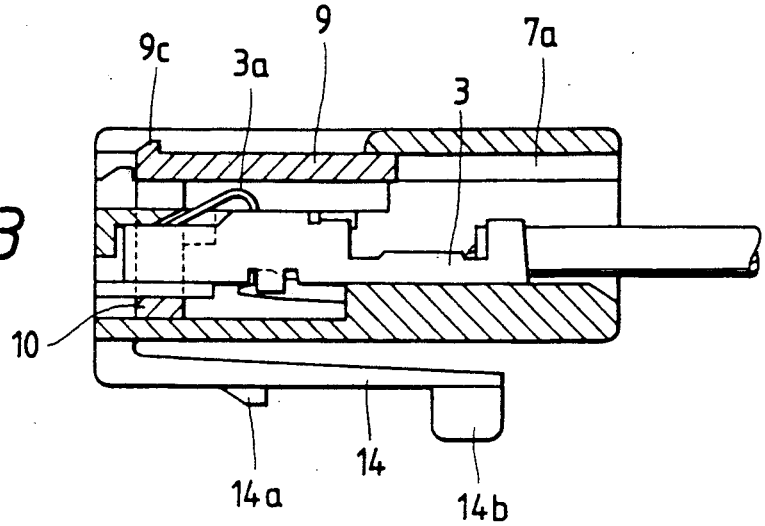
FIG. 13 is a vertical cross-sectional view of a further modified connector.
Figure 14:
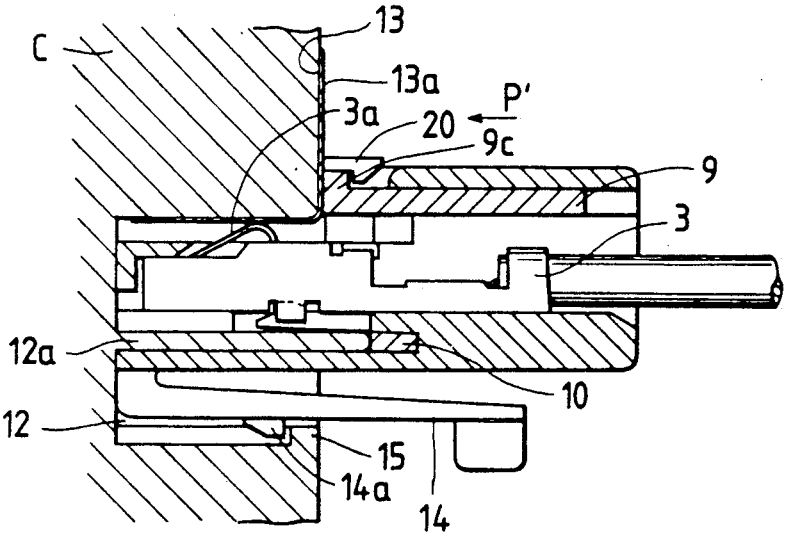
FIG. 14 is a vertical cross-sectional view, showing the fitting of the connector of FIG. 13 in the mating connector.
Figure 15:
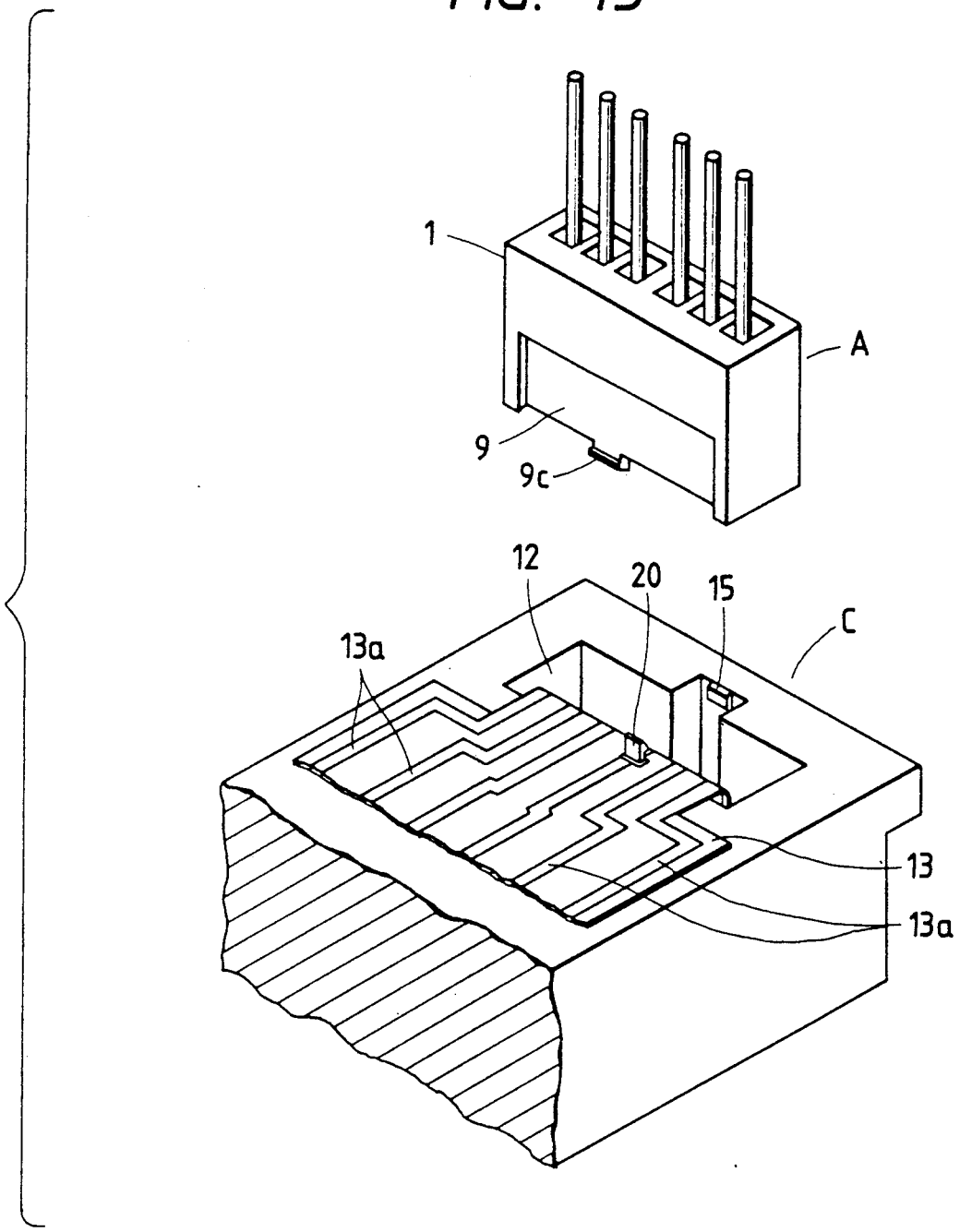
FIG. 15 is an exploded perspective view, showing the connector of FIG. 13 and the mating connector.
Figure 16:
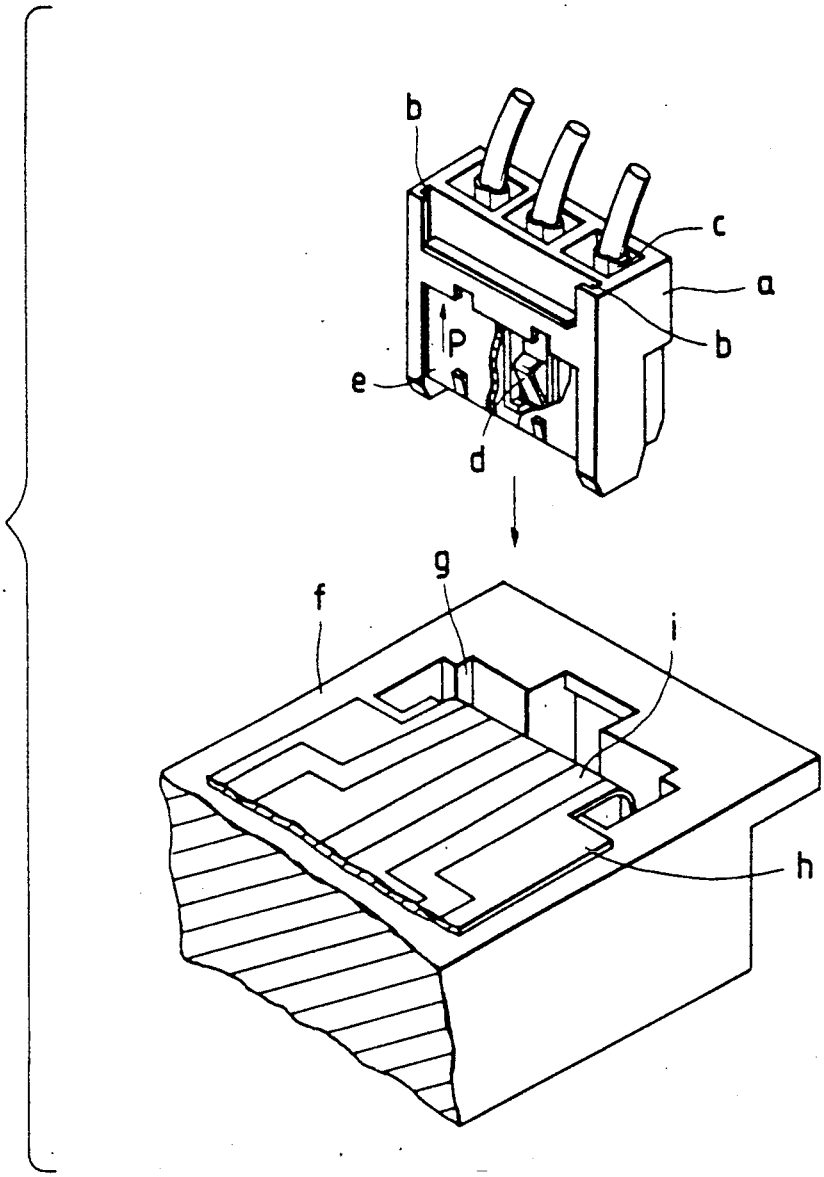
FIG. 16 PRIOR ART
FIG. 16 is an exploded perspective view, showing a conventional connector and a mating connector.

FIGS. 13 to 15 show a further modified form of the invention. This embodiment is designed to prevent damage to the resilient contact pieces 3*a* by the protective cover B failing to be closed automatically, and hence kept open upon releasing the fitting of the connector A in the mating connector C. The connector A in this embodiment is generally similar in construction to that shown in FIG. 1, the difference being that the handgrip 9*b* of the protective cover B shown in FIG. 1 is modified to have a retaining function so as to serve as a retaining portion 9*c*. The mating connector C has an upstanding retaining portion 20 extending through the printed circuit board 13. When the connector A is fitted in the mating connector C, the retaining portion 9*c* and the retaining portion 20 are engaged with each other in a manner shown in FIG. 14.

In the condition shown in FIG. 14, when the connector A is to be detached from the mating connector C, the protective cover B is moved in its closing direction (i.e., a direction of arrow P') as the releasing of the fitting of the connector A proceeds, because the retaining portion 20 of the mating connector C is engaged with the retaining portion 9*c* of the protective cover B. When this fitting is released, the closed condition shown in FIG. 3 is restored. Therefore, when the fitting of the connector A is released, the protective cover B is brought into its closed condition without fail, and therefore forgetting to close the exposing surfaces of the resilient contact pieces 3*a* can be prevented positively.

If a drive projection 12*a* similar to that shown in FIG. 4 is provided on the mating connector C, the drive projection 12*a* urges the detecting member 10 to open the protective cover B when the connector A is being fitted in the mating connector C.

In the present invention, the above embodiments can be suitably combined to obtain a connector capable of achieving all of the advantageous effects described, including the following:

(1) When the terminal is inserted imperfectly, the protective cover will not be opened, thereby preventing imperfect connection.

(2) When the connector is to be fitted in the mating connector, the protective cover abuts the drive projection or the urging projection provided on the mating connector, and therefore the printed circuit board is not subjected to an unnecessary force and will not be damaged.

(3) The protective cover can be maintained in its closed condition, and will not be opened accidentally, thus avoiding deformation or damage of the resilient contact pieces.

(4) When the fitting of the connector in the mating connector is released, the protective cover is closed automatically, and therefore damage to the resilient contact pieces resulting from forgetting to close the protective cover is prevented.

While the invention has been described in detail above with reference to a preferred embodiment, various modifications within the scope and spirit of the invention will be apparent to people of working skill in this technological field. Thus, the invention should be considered as limited only by the scope of the appended claims.

What is claimed is:

1. An electrical connector comprising:

a connector housing having a terminal-receiving chamber, a detecting space being provided adjacent to said terminal-receiving chamber, wherein a terminal having a resilient contact piece is inserted into said terminal-receiving chamber of said connector housing in such a manner that said resilient contact piece of said terminal is exposed from said terminal-receiving chamber; and a protective cover on said connector housing, disposed so as to move slidingly between an open position and a closed position, for protecting said resilient contact piece, said protective cover comprising a cover body, a detecting member, and a connecting lever interconnecting said cover body and said detecting member, said detecting member being received movably in said detecting space;

wherein said electrical connector further comprises a flexible retainer piece for retaining said terminal received in said terminal-receiving chamber said flexible retainer piece being provided displaceably between said terminal-receiving chamber and said detecting space;

such that, when said terminal is inserted imperfectly into said terminal-receiving chamber, said flexible retainer piece prevents said detecting member from advancing.

2. An electrical connector comprising:

a connector having a terminal-receiving chamber, a detecting space being provided adjacent to said terminal-receiving chamber, wherein a terminal having a resilient contact piece is inserted into said terminal-receiving chamber of said connector housing in such a manner that said resilient contact piece of said terminal is exposed from said terminal-receiving chamber;

a protective cover, mounted on said connector housing so as to move slidingly between an open position and a closed position, for protecting said resilient contact piece, said protective cover comprising a cover body, a detecting member, and a connecting lever interconnecting said cover body and said detecting member, said detecting member being received movably in said detecting space;

said electrical connector being adapted to be fitted in a mating connector having a drive projection for abutment against said protective cover;

wherein said electrical connector further comprises a flexible retainer piece for retaining said terminal received in said terminal-receiving chamber, said flexible retainer piece being provided displaceably between said terminal-receiving chamber and said detecting space;

such that, when said terminal is inserted imperfectly into said terminal-receiving chamber, said flexible retainer piece prevents said detecting member from advancing.

3. An electrical connector comprising:

a connector housing having a terminal-receiving chamber, wherein a terminal having a resilient contact piece is inserted into said terminal-receiving chamber of said connector housing in such a manner that said resilient contact piece of said terminal is exposed from said terminal-receiving chamber; and a protective cover on said connector housing so as to move slidingly between an open and a closed position, for protecting said resilient contact piece, said protective cover having an engaging lever extending through a communicating passage;

wherein said communicating passage intersects a plane opened and closed by said protective cover and extends through said connector housing;

said electrical connector further comprising a locking arm mounted on said connector housing, said locking arm having at one end an engaging portion engageable with said engaging lever, a manipulating portion at the other end thereof, and a flexible support post intermediate the opposite ends thereof, said locking arm being secured to said connector housing by said support post.

4. An electrical connector wherein a terminal is inserted into a terminal-receiving chamber in such a manner that a resilient contact piece of said terminal is exposed from said terminal-receiving chamber, said electrical connector comprising:

a connector housing; and a protective cover, mounted on said connector housing so as to move slidingly between an open and a closed position, for protecting said resilient contact piece, said protective cover having a first retaining portion, said electrical connector being adapted to be fitted in a mating connector having a second retaining portion for retaining engagement with said first retaining portion of said protective cover.

5. The electrical connector according to claim 4, wherein said mating connector includes a printed circuit board for pressing contact with said resilient contact piece, said second retaining portion of said mating connector being an upstanding member which extends through said printed circuit board.

* * * * *